US007708498B2

(12) United States Patent
Ellis et al.

(10) Patent No.: US 7,708,498 B2
(45) Date of Patent: May 4, 2010

(54) SOFT STOP FOR MAXIMUM RISER TENSIONER STROKE

(75) Inventors: Fife Baker Ellis, Houston, TX (US); Kevin Edward O'Dell, Katy, TX (US)

(73) Assignee: Vetco Gray Inc., Houston, TX (US)

( * ) Notice: Subject to any disclaimer, the term of this patent is extended or adjusted under 35 U.S.C. 154(b) by 0 days.

(21) Appl. No.: 12/038,086

(22) Filed: Feb. 27, 2008

(65) Prior Publication Data

US 2008/0205992 A1 Aug. 28, 2008

Related U.S. Application Data

(60) Provisional application No. 60/892,166, filed on Feb. 28, 2007.

(51) Int. Cl.
*E21B 17/01* (2006.01)

(52) U.S. Cl. ..... 405/224.4; 405/223.1; 166/367

(58) Field of Classification Search ..... 405/223.1, 405/224, 224.2, 224.4; 166/350, 351, 355, 166/367

See application file for complete search history.

(56) References Cited

U.S. PATENT DOCUMENTS

| | | | | |
|---|---|---|---|---|
| 5,758,990 | A * | 6/1998 | Davies et al. | 405/224.4 |
| 2004/0253059 | A1 | 12/2004 | Horton | |
| 2005/0074296 | A1 | 4/2005 | McCarty et al. | |
| 2005/0147473 | A1 * | 7/2005 | Pallini et al. | 405/224.4 |

* cited by examiner

*Primary Examiner*—Frederick L Lagman
(74) *Attorney, Agent, or Firm*—Bracewell & Giuliani

(57) ABSTRACT

A riser is connected to subsea well equipment and extends to a vessel. A tubular conductor is mounted stationarily to and around the riser, the conductor passing through an opening in the vessel. A set of rollers is mounted to the vessel around the opening for engagement with the conductor as the vessel moves relative to the riser. Hydro-pneumatic cylinder units are connected between the riser and the vessel for applying tension to the riser. An external flange is located on a lower portion of the conductor. A shock absorber is positioned around the conductor and mounted to the vessel for movement relative to the conductor. The shock absorber absorbs shock when the cylinder units are in an extreme stroke position.

17 Claims, 4 Drawing Sheets

Fig. 4
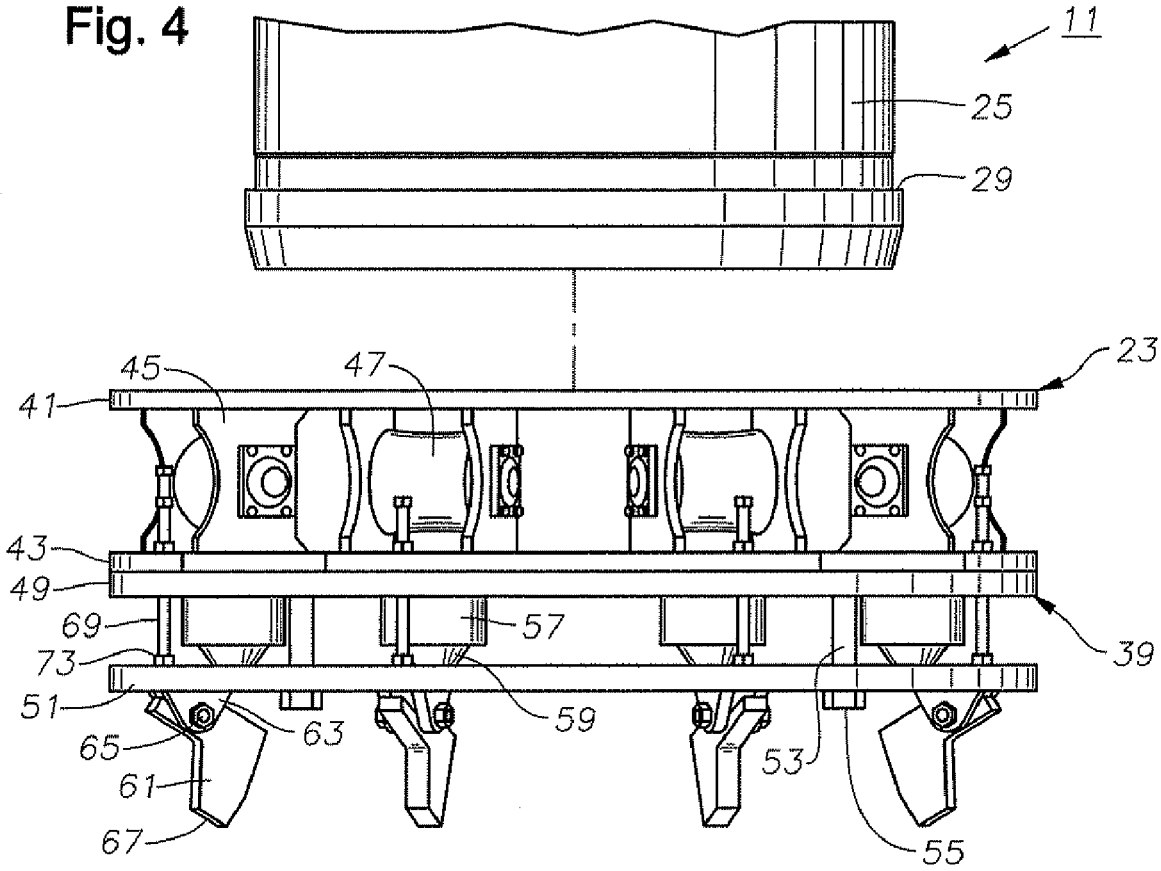
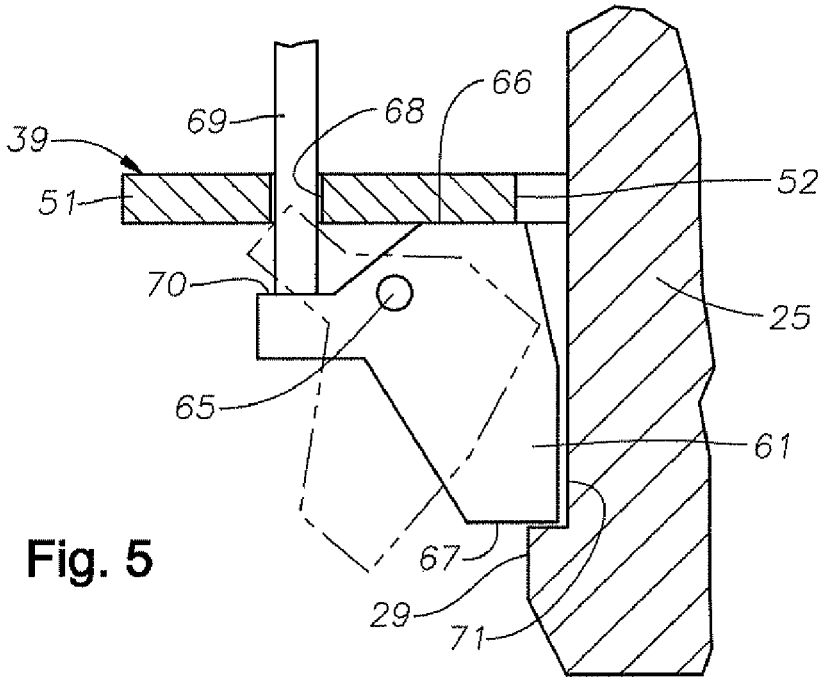
Fig. 5

SOFT STOP FOR MAXIMUM RISER TENSIONER STROKE

CROSS-REFERENCE TO RELATED APPLICATION

This application claims priority to provisional application 60/892,166, filed Feb. 28, 2007.

FIELD OF THE INVENTION

This invention relates in general to riser tensioners for offshore drilling and production vessels and in particular to a stop mechanism that cushions impact during a maximum riser tensioner stroke.

BACKGROUND OF THE INVENTION

Offshore well operations in deep water may employ a riser extending from subsea well equipment on the sea floor to a vessel or floating platform at the surface. During drilling, a drilling riser is connected to the subsea wellhead and extends to the drilling platform. During well production, production risers might extending from subsea well equipment, such as a subsea tree or manifold, to the surface platform.

Guides are employed between the riser and the opening in the vessel through which the riser passes. Typically a tubular conductor is mounted to and surrounds the riser. Bearing members, normally rollers, are mounted to the vessel and engage the conductor.

It is important to keep tension in these risers as the vessel rises and falls due to wave movement and/or currents. A tensioner assembly having hydro-pneumatic cylinder units is connected between the riser. As the vessel moves toward and away from the subsea wellhead, the cylinder units extend and retract to keep a generally uniform level of tension in the risers. Normally, the waves are not steep enough to cause the cylinder units to reach a maximum stroke position where the pistons bottom out on the cylinders. A possibility exists, however, that such waves could occur during extreme weather, such as hurricanes. If so, damage could occur to the cylinders.

SUMMARY

In this invention, an apparatus is incorporated with the riser and vessel to reduce shock if the tensioner reaches an extreme stroke position. A stop and a shock absorber are used, one adapted to be mounted to the vessel and the other to the conductor. The stop and the shock absorber are axially movable relative to each other in response to waves and/or currents, so that during an extreme stroke position of the riser tensioner, the stop and the shock absorber impact each other for absorbing shock. The impact of the stop and the shock absorber occur before the riser tensioner piston tops out in the cylinder.

In the preferred embodiment, the stop comprises a flange on the conductor, and the shock absorber is adapted to be mounted to the vessel. The flange is preferably on a lower end of the conductor. The shock absorber comprises upper and lower annular frame members that are movable toward and away from each other. At least one resilient member is located between the frame members. In the preferred embodiment, a plurality of resilient members are located between and spaced around the upper and lower frame members.

Preferably the frame members have central openings larger in diameter than an outer diameter of the flange. A plurality of dogs are mounted to the lower frame member and movable between an installation position, which allows the flange to pass downwardly through the central opening in the lower frame member, and an operational position, which prevents the bottom frame member from passing downwardly past the flange. The dogs preferably pivot between the installation position and the operational position. During a maximum downward movement of the vessel relative to the riser, an upper surface of each of the dogs contacts the frame member and a lower surface of each of the dogs contacts the flange to pass the impact force to the lower frame member.

BRIEF DESCRIPTION OF THE DRAWINGS

FIG. 4 is an enlarged side view of the lower guide rollers and the shock absorber of FIG. 1, shown during installation of the conductor of the riser tensioner.

FIG. 5 is a further enlarged, partially sectioned view of a portion of the shock absorber of FIG. 1, shown after the conductor has been inserted through the shock absorber.

DETAILED DESCRIPTION OF THE INVENTION

Figure 1:
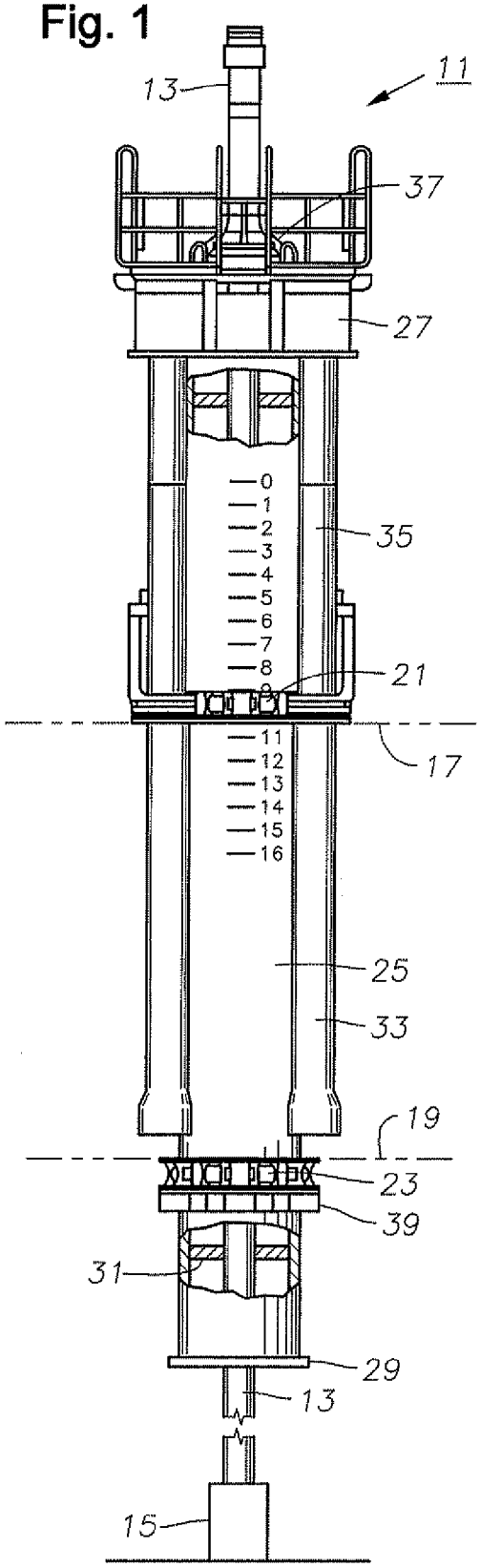
FIG. 1 is a side view, partially sectioned, of a riser tensioner having a shock absorber in accordance with the invention and shown during a normal operating position.

Referring to FIG. 1, riser tensioner assembly 11 is utilized on offshore drilling and/or production floating platforms, and may be one of several on the same platform. Riser tensioner assembly 11 is employed to maintain a desired tension in a riser 13 that extends from the vessel or platform to subsea well equipment 15 on the sea floor. Riser 13 may be a drilling riser for drilling new wells or it may be a production riser for production fluid flow. Subsea well equipment 15 may be a subsea wellhead housing, a subsea tree, a subsea manifold or other type of hydrocarbon recovery equipment. The vessel is subject to vertical and translational movement relative to subsea equipment 15 because of currents and waves.

Riser tensioner assembly 11 is mounted between an upper deck 17 and a lower deck 19 of the vessel. Decks 17, 19 are a fixed distance apart and move in unison with the vessel. In this embodiment, riser tensioner assembly 11 has two bearing members, which comprise an upper set of guide rollers 21 mounted to upper deck 17 and a lower set of guide rollers 23 mounted to lower deck 19. Riser tensioner assembly 11 has a conductor 25, which is a large diameter pipe that extends through guide rollers 21, 23 and is stationary relative to riser 13. Vessel decks 19, 21 and upper and lower guide rollers 21, 23 thus move relative to conductor 25. Conductor 25 has an upper end that is rigidly secured to a top frame 27. Conductor 25 has a stop that comprises an external flange 29 located at its lower end. Riser 13 extends through conductor 25 and may be centrally supported by a number of centralizers 31. Alternately, conductor 25 could be mounted to the vessel for movement therewith, and the guide rollers 21, 23 could be mounted to the riser 13.

In this embodiment, it is desired to continually maintain tension throughout the length of riser 13, regardless of movement of decks 17, 19. Each riser tensioner assembly 11 has a plurality of hydro-pneumatic cylinders 33 that in this embodiment are mounted to upper deck 17 and extend downward from upper guide rollers 21 to a point above lower deck 17. A piston shaft 35 extends from each cylinder 33 to top frame 27. Fluid pressure acts against a piston within each cylinder 33 for extending and retracting each piston shaft 35 and for applying an upward force to top frame 27. A clamp 37 at top frame 27 clamps riser 13 to top frame 27.

Figure 2:
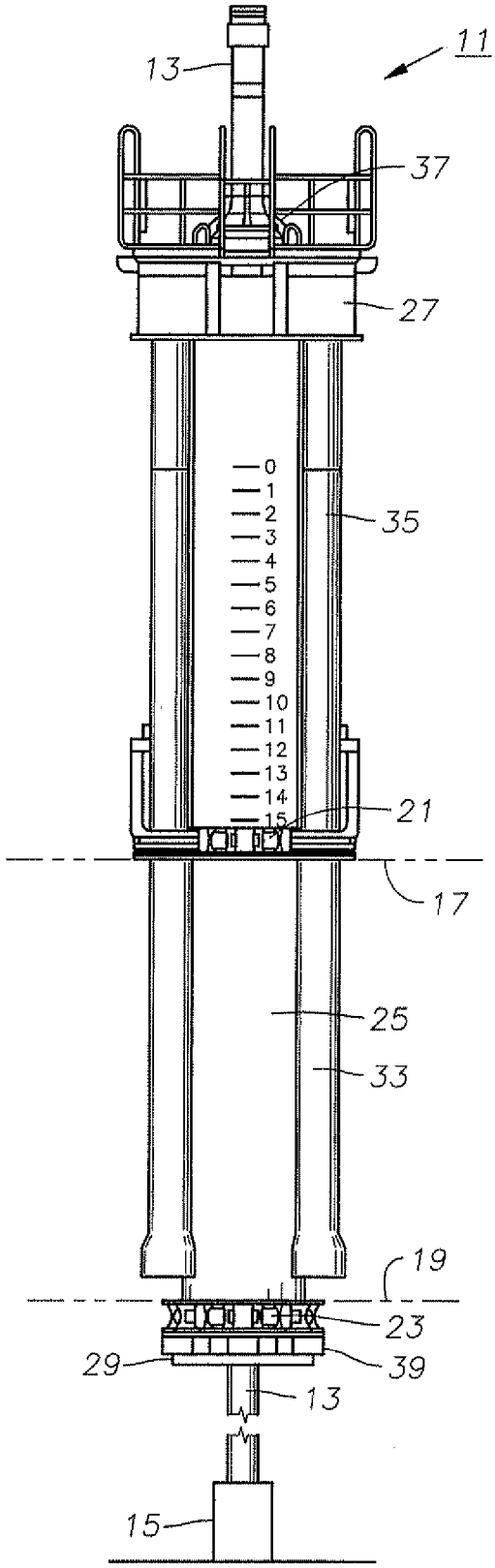
FIG. 2 is a side view of the riser tensioner of FIG. 1, shown in a maximum extended position.
Figure 3:
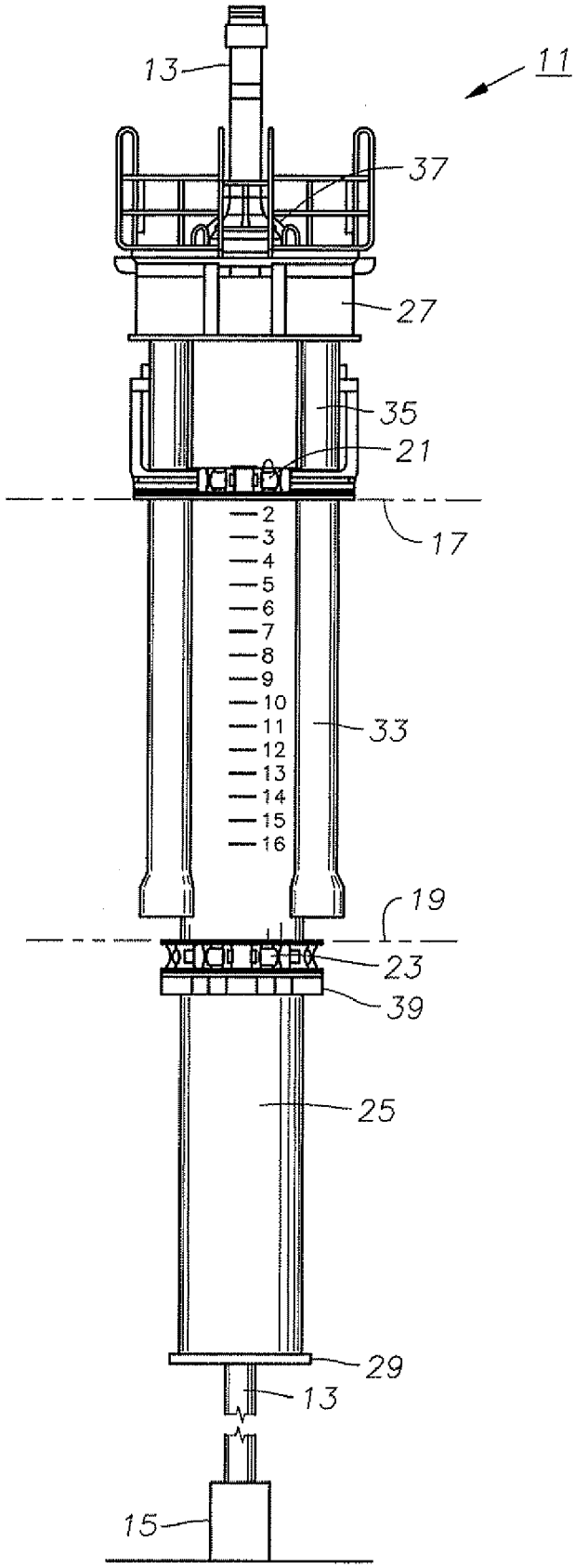
FIG. 3 is a side view of the riser tensioner of FIG. 1 shown in a maximum contracted position.

A shock absorber 39 is mounted to lower guide rollers 23, thus shock absorber 39 moves in unison with the vessel in this embodiment. While in the normal operating position of FIG. 1, shock absorber 39 is positioned well above flange 29 at the lower end of conductor 25. FIG. 2 illustrates an extremely low position for the vessel, such as in the trough of a huge wave in a severe hurricane. In this position, shock absorber 39 lands on conductor flange 29 and piston shafts 35 extend to a maximum length stroke to maintain the desired tension in riser 13. Preferably, the impact of shock absorber 39 on flange 29 occurs before the pistons top out in cylinders 33. FIG. 3 shows the vessel moving away from subsea well equipment 15, such as at the peak of a big wave. In this position, piston shafts 35 are fully retracted to avoid over tensioning riser 13, and shock absorber 39 is located a full stroke distance above conductor external flange 29. Alternately, shock absorber 39 could be mounted stationarily on conductor 25 and a stop, such as flange 29, mounted on the vessel.

Referring to FIG. 4, lower guide rollers 23 may be of a variety of types. In this type, guide rollers 23 include an upper plate 41 and a lower plate 43, each of which extends around conductor 25 in a plane perpendicular to the axis of conductor 25. Braces 45 extend vertically between plates 41, 43, securing them to each other at a fixed distance. A plurality of rollers 47 are mounted between braces 45 for engaging conductor 25.

Figure 6:
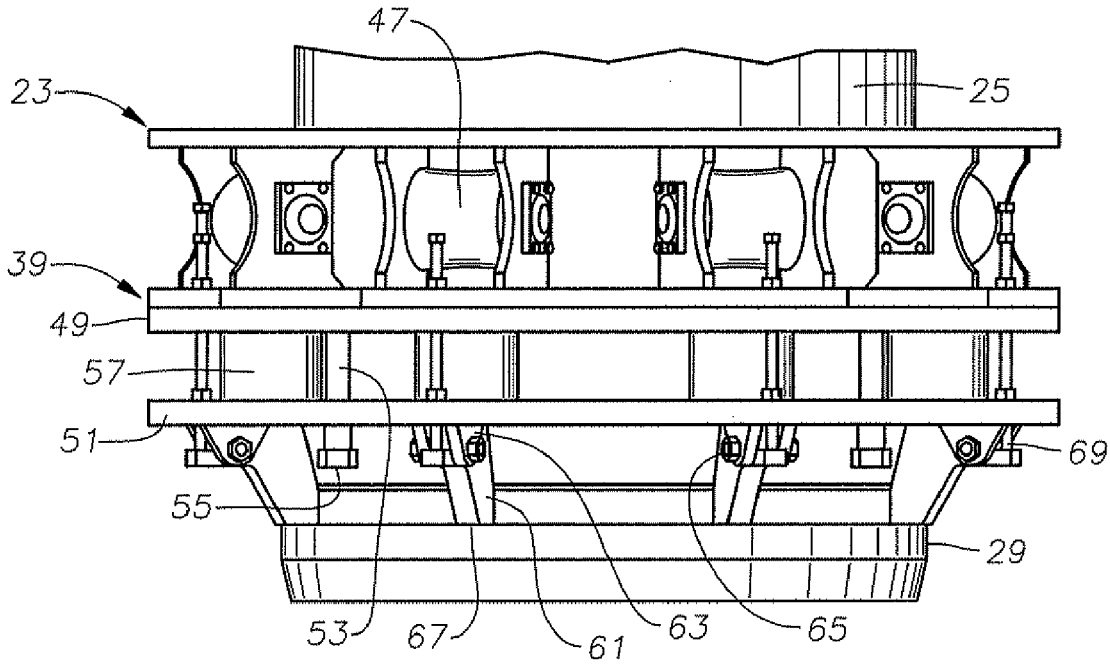
FIG. 6 is a side view of the lower guides rollers and the shock absorber of FIG. 1, shown with the tensioner in the maximum extended position.

Shock absorber 39 comprises a top frame 49 and a bottom frame 51 in this example. Top frame 49 is secured to lower plate 43 of lower guide rollers 23 in any suitable manner, such as by bolts. Frames 49, 51 comprise circular flat plates similar to plates 41, 43 of guide rollers 23. Each frame 49, 51 has a central hole 52 (FIG. 5) through which conductor 25 extends. Bottom frame 51 is movable vertically a short distance relative to top frame 49. A number of retaining pins 53 extends between frames 49, 51 to retain bottom frame 51 with top frame 49. Each retaining pin 53 is stationarily secured to top frame 49 for movement therewith. Each retaining pin 53 extends through a hole in bottom frame 51. A nut 55 at the lower end of each retaining pin 53 retains bottom frame 51 while in its lower position relative to top frame 49, which is the position shown in FIGS. 4 and 7. FIG. 6 shows bottom frame 51 moved upward relative to retaining pins 53 and top frame 49 to an upper position. Alternatively, retaining pins 53 could be mounted stationarily to bottom frame 51 and extend through holes in top frame 49.

Figure 7:
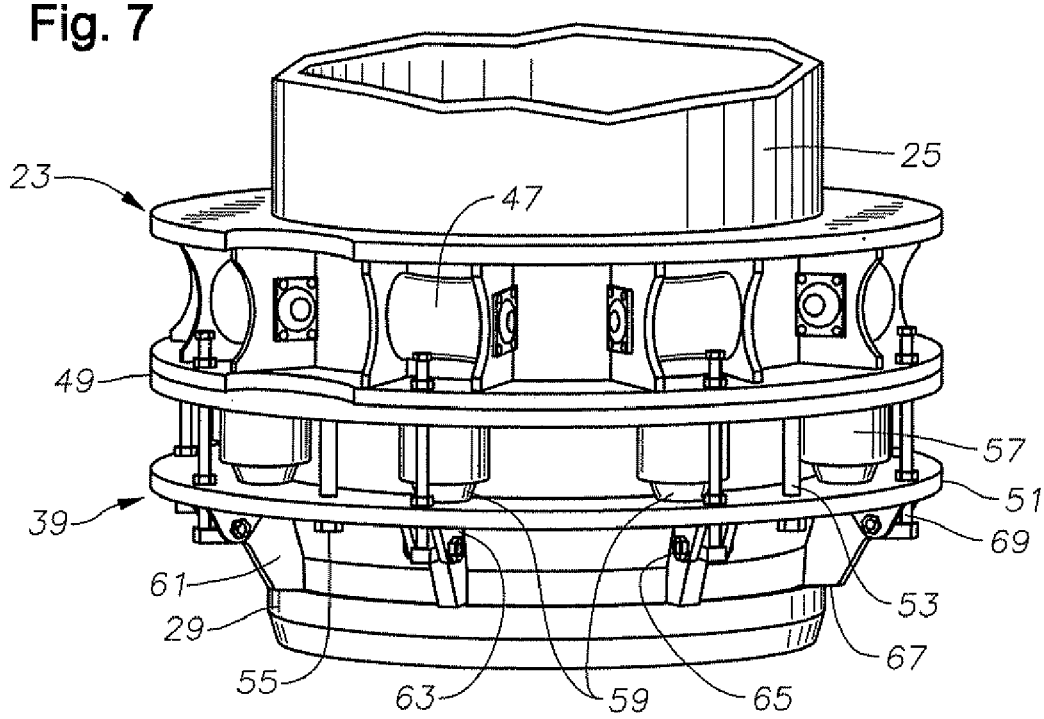
FIG. 7 is a perspective view of the lower guide rollers and the shock absorber of FIG. 1, shown with the riser tensioner near its maximum stroke position.

A plurality of dampers or resilient members are located between frames 49 and 51 to dampen upward movement of bottom frame 51 to relative to top frame 49. In this example, each damper comprises a tubular steel housing 57 containing a flexible spring element 59. Spring element 59 may comprise an elastomeric member or a coil spring and it initially protrudes from an open end of damper housing 57. In this example, damper housing 57 is mounted to top frame 49 and damper spring element 59 extends downward and is biased into contact with bottom frame 51. However, housing 57 and spring element 59 could be inverted, if desired. FIGS. 4 and 7 show spring elements 59 protruding from housings 57 while FIG. 6 shows spring elements 59 fully compressed within their housings 57.

Referring to FIG. 4, shock absorber 39 also has a plurality of load transfer dogs 61. Dogs 61 are uniformly spaced around the circumference of bottom frame 51. In this example, each dog 61 comprises a flat plate that is pivotally mounted to a clevis 63 by a pivot pin 65. Each clevis 63 is welded or otherwise secured to the lower side of bottom frame 51. Each dog 61 has a lower edge 67 that when in the operational position of FIGS. 5-7 faces downward for engagement by external flange 29 when tensioner assembly 11 is in the fully extended position of FIG. 2. Each dog 61 has an upper edge 66 that contacts the lower side of bottom frame 51 while in the operational position. An inner edge 71 of each dog 61 is closely spaced to the outer diameter of conductor 25 while in the operational position. Each dog has an upward-facing cam edge 70 located radially outward from pivot pin 65.

Referring to FIG. 5, for each dog 61, an adjustment pin 69 is secured to top frame 49 (FIG. 4) and extends downward into a hole 68 in bottom frame 51. In the assembly position, illustrated by the dotted lines of FIG. 5, the lower end of each adjustment pin 69 is recessed within hole 68. Adjustment pin 69 has a threaded section that engages a threaded hole in top frame 49 (FIG. 4). When rotated, adjustment pin 69 moves downward against cam edge 70 of dog 61 to cause dog 61 to rotate about pivot pin 65 to the operational position shown by the solid lines of FIG. 5. Adjustment pin 69 is locked in a desired position by tightening a nut 73 (FIG. 4) against top frame 49.

During assembly of riser tensioner 11 to the vessel, lower guide rollers 23 and shock absorber 39 will be secured to each other and mounted to lower deck 19 (FIG. 1) of the vessel before installation of conductor 25. In the installation position shown in FIG. 4 and by the dotted lines of FIG. 5, each dog 61 is free to pivot about its pivot pin 65 and will hang downward by its own weight. In this position, the inner diameter circumscribed by the inner edges 71 of dogs 61 is greater than the outer diameter of conductor flange 29. Conductor 25 is then lowered through upper guide rollers 21 (FIG. 1), lower guide rollers 23 and shock absorber 39. The freely pivotal dogs 61 allow flange 29 to pass through shock absorber 39 as conductor 25 is lowered even if flange 29 happens to contact inner edges 71. After the upper end of conductor 25 lands on tensioner top frame 27 (FIG. 1), the operator rotates adjustment pins 69, causing each dog 61 to pivot about its pivot point 65. When upper edge 66 contacts the lower side of bottom frame 51, the operator will tighten nut 73 (FIG. 4). Dogs 61 will then remain in the operational position of FIGS. 5-7. The inner edges 71 will define an inner diameter that is smaller than the outer diameter of conductor flange 29 and slightly larger than the outer diameter of conductor 25 above flange 29.

In operation, shock absorber 39 will move in unison with the vessel and its upper and lower decks 17, 19, as can be seen by comparing FIGS. 1-3. Downward and upward movement of vessel decks 17, 19 relative to conductor 25 cause piston shafts 35 to extend and retract to maintain a desired tension in riser 13. If the downward movement is great enough, it is possible for shock absorber 39 to impact external flange 29 of conductor 25, as shown in FIG. 2. Referring to FIG. 7, when lower edges 67 of dogs 61 contact external flange 29, an upward force from flange 29 is transferred through upper edges 66 (FIG. 5), bottom frame 51 and to damper spring elements 59, which absorb shock and collapse within damper housings 57. When damper spring elements 59 are fully collapsed (FIG. 6), the upward force passes through damper housings 57, top frame 49 and lower guide rollers 23 to lower deck 19 (FIG. 2).

As the vessel rises from the trough of the large wave, decks 17, 19 move upward relative to conductor 25, as shown by comparing FIGS. 2 and 3, which moves shock absorber 39 above the external flange 29. Bottom frame 51 moves back down to the lower position (FIG. 7) relative to top frame 49 and damper spring elements 59 protrude from damper housings 57.

The shock absorber reduces the possibility of damage occurring to the riser tensioner cylinders because it stops extension of the tensioner cylinder units before the pistons top out. The pivotal load transfer dogs facilitate installation of the riser conductor.

While the invention has been shown in only one of its forms, it should be apparent to those skilled in the art that it is not so limited, but is susceptible to various changes without departing from the scope of the invention. For example, although the shock absorber and stop only operation during maximum extension of the tensioner cylinder units, similar arrangements could be used to restrict maximum contraction.

The invention claimed is:

1. An apparatus for reducing shock to a riser tensioner occurring during an extreme stroke position, the riser tensioner adapted to be connected between a riser that extends from subsea well equipment through an opening in a vessel, the apparatus comprising:

a tubular conductor that is adapted to surround the riser where the riser passes though the opening in the vessel; and a stop and a shock absorber, one being adapted to be mounted to the vessel and the other to the conductor, the stop and the shock absorber being axially movable relative to each other and relative to the axis of the conductor, so that during an extreme stroke position of the riser tensioner, the stop and the shock absorber impact each other for absorbing shock, wherein the shock absorber comprises:

upper and lower annular frame members that are movable toward and away from each other; and at least one resilient member between the frame members.

2. The apparatus according to claim 1, wherein the stop comprises a flange on the conductor, and the shock absorber is adapted to be mounted to the vessel.

3. The apparatus according to claim 1, wherein the stop comprises a flange on a lower end of the conductor.

4. An apparatus for reducing shock to a riser tensioner occurring during an extreme stroke position, the riser tensioner adapted to be connected between a riser that extends from subsea well equipment through an opening in a vessel, the apparatus comprising:

a tubular conductor that is adapted to surround the riser where the riser passes though the opening in the vessel; and a stop and a shock absorber, one being adapted to be mounted to the vessel and the other to the conductor, the stop and the shock absorber being axially movable relative to each other and relative to the axis of the conductor, so that during an extreme stroke position of the riser tensioner, the stop and the shock absorber impact each other for absorbing shock, wherein the shock absorber comprises:

upper and lower annular frame members that are movable toward and away from each other; and a plurality of shock absorbing cylinders spaced circumferentially around and to one of the frame members, each of the cylinders having a resilient member that engages the other of the frame members.

5. An apparatus for reducing shock to a riser tensioner occurring during an extreme stroke position, the riser tensioner adapted to be connected between a riser that extends from subsea well equipment through an opening in a vessel, the apparatus comprising:

a tubular conductor that is adapted to surround the riser where the riser passes though the opening in the vessel; and a stop and a shock absorber, one being adapted to be mounted to the vessel and the other to the conductor, the stop and the shock absorber being axially movable relative to each other and relative to the axis of the conductor, so that during an extreme stroke position of the riser tensioner, the stop and the shock absorber impact each other for absorbing shock, wherein:

the stop comprises a flange on a lower end of the conductor; and the shock absorber comprises:

an annular frame member having a central opening larger in diameter than an outer diameter of the flange; and a plurality of dogs mounted to the frame member and movable between an installation position, which allows the flange to pass downwardly through the central opening in the frame member, and an operational position, which prevents the bottom frame member from passing downwardly past the flange.

6. The apparatus according to claim 5, wherein each of the dogs is pivotally mounted to the frame member and pivots between the installation position and the operational position.

7. The apparatus according to claim 5, wherein while in the operational position and during a maximum downward movement of the vessel relative to the riser, an upper surface of each of the dogs contacts the frame member and a lower surface of each of the dogs contacts the flange.

8. An apparatus for reducing shock to a riser tensioner occurring during an extreme stroke position, the riser tensioner adapted to be connected between a riser that extends from subsea well equipment through an opening in a vessel, the apparatus comprising:

a tubular conductor that is adapted to surround the riser where the riser passes though the opening in the vessel; and a stop and a shock absorber, one being adapted to be mounted to the vessel and the other to the conductor, the stop and the shock absorber being axially movable relative to each other and relative to the axis of the conductor, so that during an extreme stroke position of the riser tensioner, the stop and the shock absorber impact each other for absorbing shock, further comprising:

a plurality of rollers mounted to the shock absorber in rolling engagement with the conductor.

9. An apparatus for reducing shock to a riser tensioner occurring during an extreme stroke position, the riser tensioner adapted to be connected between a riser that extends from subsea well equipment through an opening in a vessel, the apparatus comprising:

a tubular conductor that is adapted to surround the riser where the riser passes though the opening in the vessel; and a stop and a shock absorber, one being adapted to be mounted to the vessel and the other to the conductor, the stop and the shock absorber being axially movable relative to each other and relative to the axis of the conductor, so that during an extreme stroke position of the riser tensioner, the stop and the shock absorber impact each other for absorbing shock, wherein the shock absorber comprises:

upper and lower annular frame members that are movable toward and away from each other, the upper annular frame member adapted to be mounted stationarily to the vessel; and a plurality of shock absorbing cylinders spaced circumferentially around and between the frame members, each of the cylinders having a resilient member that engages one of the frame members; and the apparatus further comprises:

a set of rollers mounted to the upper frame member and in rolling engagement with the conductor.

10. An apparatus for performing subsea well operations, comprising:

a vessel;

a riser adapted to be connected to subsea well equipment and extending to the vessel;

a tubular conductor mounted stationarily to and around the riser, the conductor passing through an opening in the vessel;

a bearing member mounted to the vessel around the opening for engagement with the conductor as the vessel moves relative to the riser;

a plurality of hydro-pneumatic cylinder units, each having a piston, the cylinder units being connected between the riser and the vessel for applying tension to the riser, the cylinder units being spaced around the conductor;

an external flange on a lower portion of the conductor; and a shock absorber positioned around the conductor and mounted to the vessel for movement relative to the conductor, the shock absorber having at least one resilient member for absorbing shock when the shock absorber impacts the external flange.

11. The apparatus according to claim 10, wherein the shock absorber comprises:

upper and lower annular frame members that are movable toward and away from each other along a longitudinal axis of the conductor, one of the frame members being rigidly attached to the vessel; and wherein said at least one resilient member comprises a plurality of resilient members spaced circumferentially around and between the frame members.

12. The apparatus according to claim 10, wherein the shock absorber comprises:

upper and lower annular frame members that are movable toward and away from each other along a longitudinal axis of the conductor, one of the frame members rigidly attached to the vessel; and wherein said at least one resilient member comprises a plurality of shock absorbing cylinders spaced circumferentially around and between the frame members.

13. The apparatus according to claim 10, wherein the shock absorber comprises:

an annular bottom frame member having a central opening larger in diameter than an outer diameter of the flange; and a plurality of dogs mounted to the bottom frame member and movable between an installation position, which allows the flange to pass downwardly through the bottom frame member, and an operational position, which prevents the bottom frame member from passing downwardly past the flange.

14. The apparatus according to claim 13, wherein while in the operational position and during a maximum stroke of the cylinder units, an upper surface of each of the dogs contacts the bottom frame member and a lower surface of each of the dogs contacts the flange.

15. The apparatus according to claim 13, wherein each of the dogs is pivotally mounted to the bottom frame member and pivots between the installation position and the operational position.

16. The apparatus according to claim 10, wherein the shock absorber is mounted to a lower side of the bearing member.

17. A method for reducing shock to a riser tensioner occurring during an extreme stroke position, the riser tensioner being connected between a riser that extends from subsea well equipment through an opening in a vessel, the riser being surrounded by a tubular conductor where the riser passes through the opening, the method comprising:

providing a stop and a shock absorber and mounting them to the vessel and to the conductor for axial movement relative to each other in response to waves and/or currents, wherein the step of mounting the stop and the shock absorber to the vessel comprises providing a flange on the conductor to serve as the stop and mounting the shock absorber on the vessel, the shock absorber having a central passage with an expanded installation position and a contracted operational position, and wherein during installation the stop is lowered through the passage in the shock absorber while the shock absorber is in the expanded installation position, then the shock absorber is placed in the contracted operational position; and during an extreme stroke position of the riser tensioner, impacting the stop and the shock absorber and absorbing shock.

* * * * *